United States Patent [19]

Wier

[11] 4,428,103

[45] Jan. 31, 1984

[54] LOCK FOR A SAFETY BELT

[75] Inventor: Franz Wier, Schwäbisch-Gmünd, Fed. Rep. of Germany

[73] Assignee: REPA Feinstanzwerk GmbH, Alfdorf, Fed. Rep. of Germany

[21] Appl. No.: 231,012

[22] Filed: Feb. 3, 1981

[30] Foreign Application Priority Data

Feb. 5, 1980 [DE] Fed. Rep. of Germany ..... 3004169

[51] Int. Cl.[3] ..... A44B 11/26

[52] U.S. Cl. ..... 24/654

[58] Field of Search ..... 24/230 R, 230 A, 230 BC, 24/230 TC, 230 AK, 230 AL, 230 AP, 230 AT

[56] References Cited

U.S. PATENT DOCUMENTS

| | | | |
|---|---|---|---|
| 3,807,000 | 4/1974 | Weman | 24/230 AL |
| 3,969,795 | 7/1976 | Stephenson | 24/230 AL |
| 4,064,603 | 12/1977 | Romanzi | 24/230 A |
| 4,092,767 | 6/1978 | Narayan | 24/230 AL |
| 4,100,657 | 7/1978 | Minolla | 24/230 AL |
| 4,197,619 | 4/1980 | Burleigh | 24/230 AL |
| 4,301,576 | 11/1981 | Cunningham | 24/230 AL |

*Primary Examiner*—Robert Peshock
*Assistant Examiner*—Kris R. Schulze
*Attorney, Agent, or Firm*—Herbert L. Lerner; Laurence A. Greenberg

[57] ABSTRACT

Lock for a safety belt, with a belt lock into which an insertion tab can be inserted and latched by a latching bolt and where the latching bolt can be moved from the locking position into the opening position transversely to the insertion path against the force of a spring by a pushbutton. The latch bolt can be detented in the locking position and/or the opening position outside the insertion path of the insertion tab by a detent element which can be moved directly or indirectly by the pushbutton or by the insertion tab.

7 Claims, 10 Drawing Figures

LOCK FOR A SAFETY BELT

CROSS-REFERENCE TO RELATED APPLICATION

The following application is related to the present application: Application Ser. No. 231,026, filed for Franz Wier, on Feb. 3, 1981, entitled "Lock for a Safety Belt".

BACKGROUND OF THE INVENTION

1. Field of the Invention

This invention relates to a lock for a safety belt, with a belt lock into which an insertion tab can be inserted and latched by a latching bolt, where the latching belt can be moved from the locking position into the opening position transversely to the insertion path against the force of a spring by a pushbutton which can be moved against the force of a spring, and is held there by a blocking element, for instance, an ejector.

2. Description of the Prior Art

In known belt locks for safety belts, the latch bolt required for locking the insertion tab connected to the loose belt section can be moved perpendicularly to the insertion path of the insertion tab against the force of a spring into an opening position by the operation of a pressure organ, for instance, a pushbutton and, after the insertion tab is withdrawn, drops back into the locking position. So that the pressure organ does not have to be operated again for inserting the insertion tab, i.e., for latching the lock, a bevel is provided at the boundary of the latch bolt on the insertion side, onto which the insertion tab introduced into the insertion path runs and subsequently shifts the latch bolt into the opening position, from which it then drops back again into the locking position after the insertion tab is fully inserted. In inserting the insertion tab, considerable friction forces must be overcome, together with gradual mechanical wear of the parts rubbing against each other. In other belt lock systems, the latch, which can likewise be moved into the opening position against the force of a spring, is held in the opening position by a spring-loaded ejector after the insertion tab is withdrawn. Here, too, considerable friction forces occur between the latch and the ejector when the lock is operated, and it cannot be precluded that with the shifting of the ejector from the blocking position, an obstruction of the insertion path by part of the latch takes place, which is no longer held securely in the opening position, whereby the insertion of the insertion tab is impeded.

SUMMARY OF THE INVENTION

It is an object of the invention to provide a lock of the abovementioned type in such a manner that reliable blocking of the latch bolt in the operating positions is ensured with simple mechanical design and avoidance of mechanical wear.

With the foregoing and other objects in view, there is provided in accordance with the invention a lock for a safety belt comprising a belt lock having a metallic support with two spaced plates defining an insertion path, an insertion tab attached to a belt end for insertion in the insertion path of the metallic support, a latching bolt movable transversely to the insertion path to the blocked position in which the bolt is interposed in the path of said tab and to the open position in which the bolt does not block passage of the tab in the insertion path, spring means urging the latching bolt to the blocked position, a pushbutton mounted on the metallic support movable against the force of a spring to move the latching bolt from the blocked position into the open position, and a detent element disposed outside the insertion path and movable to prevent transverse movement of the latching bolt.

Other features which are considered as characteristic for the invention are set forth in the appended claims.

Although the invention is illustrated and described herein as embodied in a lock for a safety belt, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which.

DETAILED DESCRIPTION OF THE INVENTION

Figure 1:
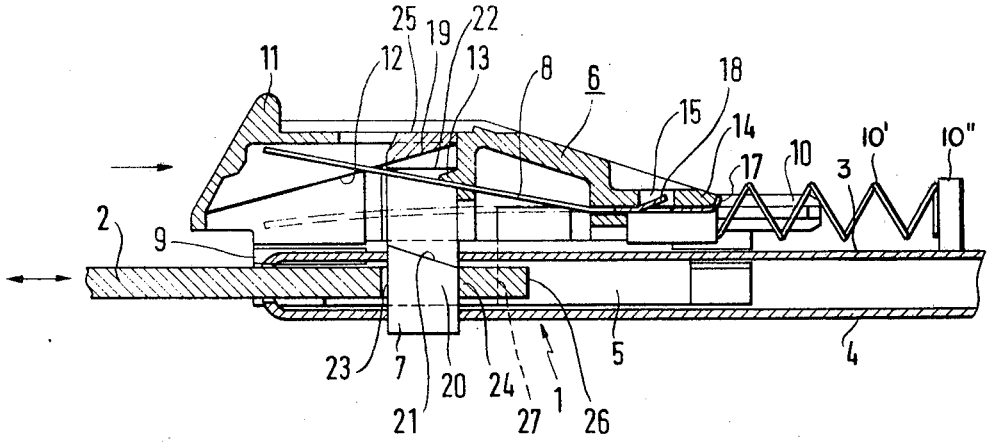
FIG. 1 shows a cross-sectional view of the lock for a safety belt according to the invention to illustrate the relationship of the insertion path of the tab, the latch bolt, the movable pushbutton and the detent element.

In accordance with the invention, the latch bolt can be detented in the locking position and/or the opening position outside the insertion path of the insertion tab by a detent element which can be moved directly or indirectly by the pushbutton or by the insertion tab. By this detent element which can preferably be shifted parallel to the insertion plane and may be part of the pushbutton or a separate part that can be moved by the pushbutton, the latch is preferably held in both opposite operating positions. Specifically, the latch is held in a position in which, in the case of the opening position, an impediment or partial obstruction of the insertion path is impossible and, in the case of the locking position, shock forces that might act on the lock cannot cause a move of the latch bolt from the locking position. Especially in the first-mentioned case, the advantage is thereby obtained that in inserting the insertion tab into the insertion path, mechanical contact of the insertion tab and the latch is reliably avoided and that overall, the insertion process is facilitated through the elimination of large friction forces. Not least, the advantage is obtained by the embodiment according to the invention that upon insertion of the insertion tab into the insertion path, the latch bolt is held in the opening position until the insertion tab is completely in the locking position, whereupon the detent position of the latch is discontinued suddenly and the latter drops into the locking position under spring force with great acceleration and in the process makes a loud click, which indicates to the user that the locking is completed.

An advantageous further embodiment of the invention is the detent element which has at least one detent surface with a bevel for executing an additional moving excursion at the latch bolt. It is achieved thus that the latch bolt is further moved by the bevels by a safety excursion, which is of importance especially in the opening position of the latch bolt in view of preventing the partial obstruction of the insertion path.

Secure guidance without tolerances of the latch bolt into the extreme detent positions as well as proper locking in these positions is promoted by the advantageous embodiment of the invention having the feature that the pushbutton has at least one cam surface which is inclined relative to the insertion plane, extends up to the height of the detent element, for the moving stroke of the latch bolt, and against which the latch bolt is pushed by spring force. It is of advantage there if the latch bolt is pushed against the cam surface by at least one spring tab which is supported at the pushbutton and extends substantially parallel to the insertion path of the insertion tab. The manual operation of the pushbutton is substantially facilitated thereby because upon pushing the pushbutton, the spring travel of the spring tab which is preferably fastened at the pushbutton end opposite the pressure extension, becomes larger and the spring force thereby becomes smaller, so that the pressure to be supplied by the user is at least not increased.

A further advantageous embodiment of the invention is provided by the feature that the latch extension or extensions has (have) in the region of the insertion path a bevel which extends inclined to the insertion path in such a manner that the latch bolt is subjected to a force component directed into the opening position of the latch bolt, if a pull is exerted on the insertion tab. There, the angle of the bevel is set so that in the event of a crash, sufficient friction forces are still available between the latch bolt and the insertion tab, which is further aided by the detent of the latch bolt in the locking position. However, during the normal withdrawal of the insertion tab, a force component into the opening position of the latch bolt is present which facilitates the release of the insertion tab from the locking position.

Further advantageous details of the invention may be gathered from the embodiment examples which are shown in the drawings and will be described in the following.

In the view according to FIG. 1, a belt lock is designated generally with 1 and an insertion tab with 2. The belt lock consists substantially of a metallic support $\frac{3}{4}$ with two plates 3 and 4 which define an insertion path 5 for the insertion tab 2 and by which the belt lock 1 can be fastened to the floor of the motor vehicle, for instance, by means of a cable. A pushbutton 6 is shown as a detail in FIG. 2. A latch bolt 7 as well as a fork-like spring tab 8 are likewise shown as details in FIG. 2. The pushbutton 6 has guide slots 9 on both sides, by which it is movably guided parallel to the insertion direction (arrow in FIG. 1) in corresponding guide edges of the upper plate 3 of the support $\frac{3}{4}$. At cantilevered pins 10 of the pushbutton 6, compression springs 10' are held. The compression springs 10' are braced against an abutment 10' of the support $\frac{3}{4}$. The pushbutton 6 can be moved against the spring force of the compression springs 10' in the direction of the arrow by manually pressing the handle 11.

Figure 2:
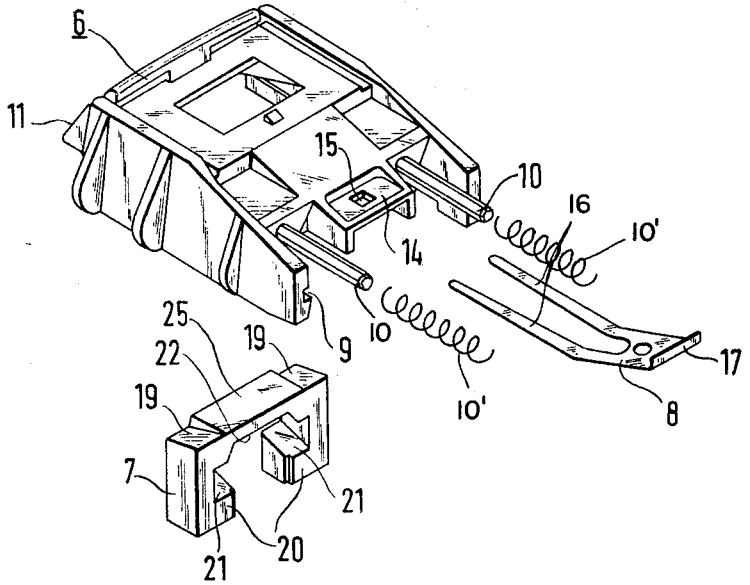
FIG. 2, shows an exploded view of a detail consisting of the pushbutton, the spring tab and latch bolt of the lock according to FIG. 1, FIGS. 3 and 4 schematically show enlarged views of the essential functional parts of the lock with particular reference to the insertion tab, latch bolt, pushbutton and detent as per FIGS. 1 and 2 according to the invention as well as in two different operating positions.

The pushbutton 6 has on both sides, offset from the center of the insertion path, two inclined track-like cam surfaces 12. Pushbutton 6 also has a projection-like detent element 13 centered at the height of the ends of the cam surfaces 12. Also, pushbutton 6 has at the rear end a mounting 14, at which the common fastening end of the spring tab 8 having two spring tines 16 is supported in an opening 15. A bent-off extension 17 of the spring tab 8 extends around the mounting 14, while a spring lug 18 is tensioned in the opening 15. The spring tab 8 which is pre-tensioned upwards in FIGS. 1 and 2, is braced against the detent element 13 and otherwise pushes the latch bolt 7 with its two inclined sliding surfaces 19 onto the cam surfaces 12 of the pushbutton 6. The latch bolt 7, incidentally, is C-shaped in design in the embodiment example, and its free leg latches have extensions 20 which are provided with bevels 21.

FIG. 1 shows the closing or locking position of the lock 1, in which the latch bolt 7 is pushed by the spring tab 8 into the uppermost cam position of the lifting surfaces 12 and in which the latch bolt 7 is detented by the detent element 13 extending beneath the lower edge 22 of the middle or non-free leg of C-shaped latch bolt 7. In this position, the latch extensions 20 of the latch bolt 7 are at the height of the insertion path 5 as well as in a locking opening 23 of the insertion tab 2. The locking edge 24 of locking opening 23 of tab 2 is braced against the vertical part of the latch extensions 20. To open the lock, the pushbutton 6 is moved in the direction of the arrow against the force of springs 10', whereby the latch bolt 7 and the detent extension 13 are disengaged and whereby the latch bolt 7, guided in guide openings in the plates 3, 4 is forced downward by the cam surfaces 12 against the force of the spring tab 8 downward into the opening position. In a defined shift position, the locking edge 24 comes into engagement with the bevels 21 whereby the latch bolt 7 is subjected to a force component which is directed in the opening position and pushes the latch bolt downward into the opening position, in which the latch bolt 7 is again detented by detent element 13 of the pushbutton returning to the rest position, and blocking bolt 7 by detent 13 extending over the upper edge 25 of bolt 7. Additionally, the latch bolt 7 can be held in the opening position by a resilient ejector, not shown, which is guided in the insertion path 5 and blocks the shifting path of the latch extensions 20, as the insertion tab 2 is withdrawn. During the shifting movement of the latch bolt 7, the latter is pressed continuously by the spring tab 8 against the cam surfaces 12, where in the course of the movement of the pushbutton 6 the spring travel of the spring tab 8 becomes larger and therefore, the pressure to be exerted at the pushbutton 6 becomes smaller. In FIG. 1, the lowest position of the spring tab 8, i.e., after the pushbutton 6 is pressed down completely, is shown dash-dotted.

In inserting the insertion tab 2 into the insertion path 5, the front edge 26 of the insertion tab 2 comes into contact with a stop 27 attached to the pushbutton 6 and extending into the insertion path 5. Continued movement of edge 26 against stop 27 shifts the pushbutton so far that the detent connection between the detent element 13 and the latch bolt 7 is released, whereby the latch bolt 7 drops back into the locking position under the force of the spring tab 8 suddenly and with an audible clicking noise.

Figure 3:
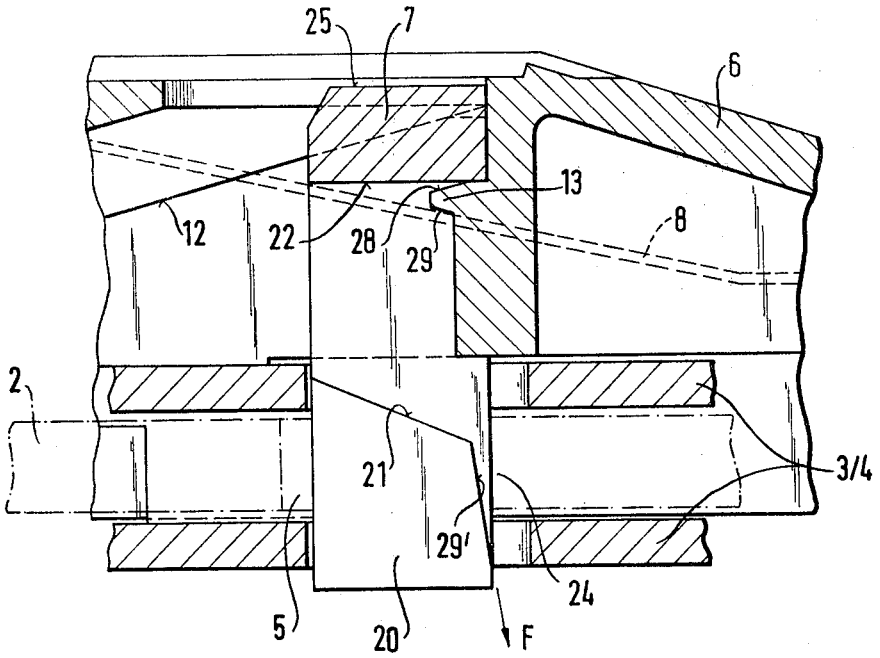
Figure 4:
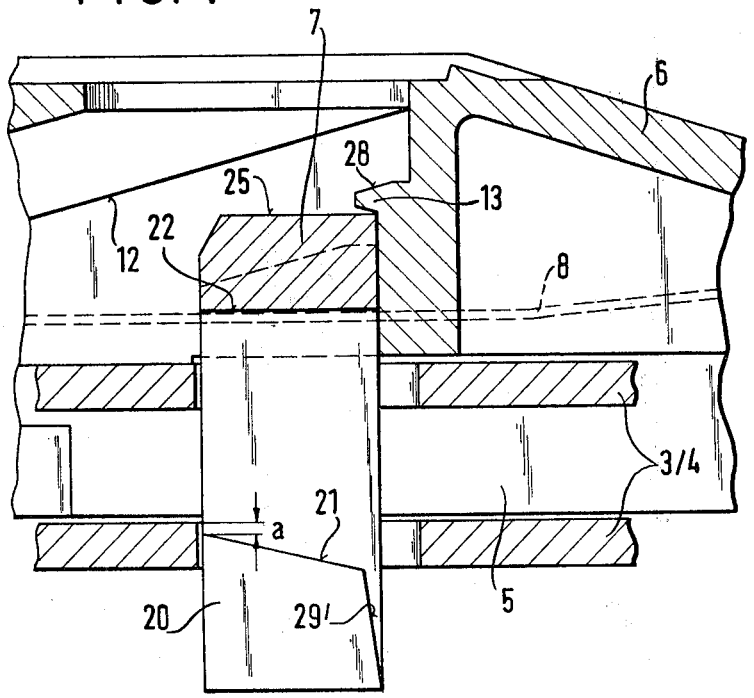

Referring to FIGS. 3 and 4, further details of the lock according to FIGS. 1 and 2 are illustrated. To avoid repetition, parts already explained are not described again. The figures show clearly that the projection-like detent element 13 has an upper bevel 28 and a lower bevel 29. In the locking position according to FIG. 3, the lower edge 22 of the latch bolt 7 runs up onto the incline 28 and is then forced by the force component acting in the upward direction to execute an additional closing stroke up into the final locking position according to FIG. 3. Conversely, the lower incline 29 pushes the latch bolt 7, in the opening position according to FIG. 4, into the final locking or blocking position by an additional excursion a. Due to this additional excursion a, the uppermost opening of the latch extension 20 in FIG. 4 is outside the insertion path 5 for the insert in tab 2 with a margin of safety. The latch extensions 20 of the latch bolt 7 further have, according to FIGS. 3 and 4 as well as in all further figures, additional bevels 29' which, in the blocking or locking position of the latch bolt 7, are in the area of the insertion path 5. After the detent connection is unlatched, the locking edge 24 of the insertion tab 2 pushes on these bevels 29', whereby a force or opening component F directed into the opening position is imparted to the latch bolt 7, whereby the withdrawal of the insertion tab 2 from the belt lock is facilitated.

Figure 5:
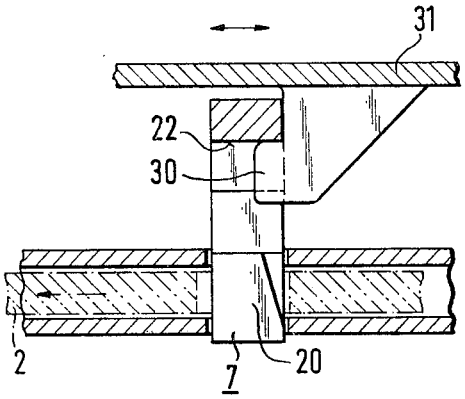
FIGS. 5 and 6, 7 and 8, 9 and 10 show different embodiments of these essential parts of the lock according to the invention schematically and always in two different operating positions.
Figure 7:
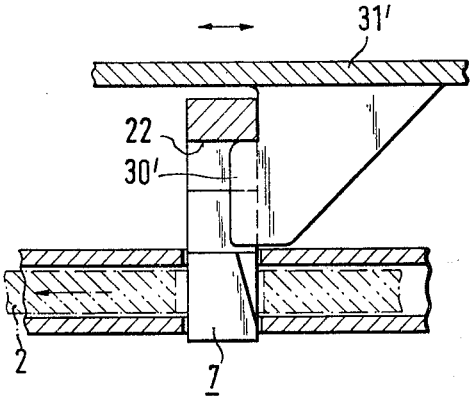
Figure 6:
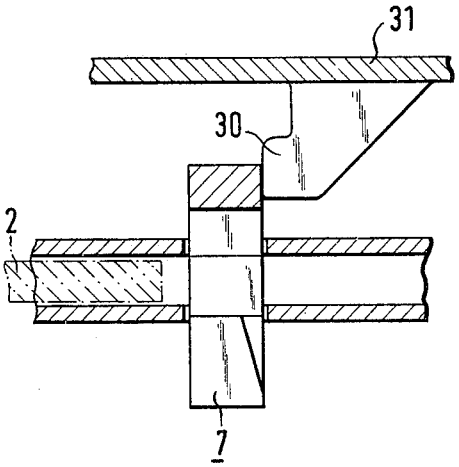
Figure 8:
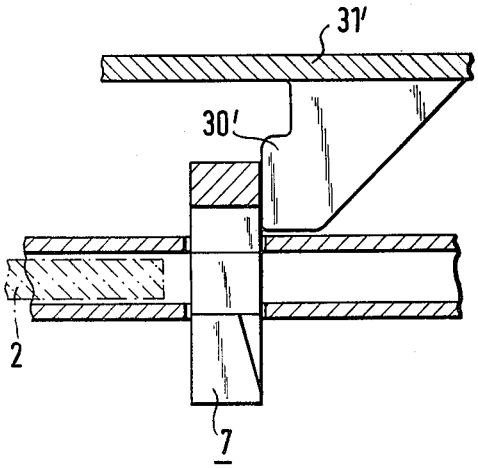

In the embodiment examples according to schematic simplified FIGS. 5/6, 7/8, and, the detent element is as in FIGS. 3/4 as piece of the pushbutton. In the embodiment examples according to FIGS. 5/6 and 7/8, the latch bolt 7 corresponds to the latch bolt design according to the preceding figures. There, the detent element 30, 30' is a piece of 31, 31' shown as a simplified representation of the pushbutton which can move in the belt lock in the direction of the arrow by manually pressing in one arrow direction and by compression on springs in the other arrow direction as described in connection with FIGS. 1 and 2. According to FIGS. 5 and 6 the detent element 30 has a height which covers the distance between the edge 22 and the latch extensions 20 of the latch bolt 7 only in part, while in the embodiment example according to FIGS. 7 and 8, the height of the detent element 30' substantially corresponds to the above-mentioned distance in the latch bolt 7. As FIGS. 5 and 7 show, the detent elements 30, 30' are detented in the locking position with the edges 22 of the latch bolt 7, while in the opening position according to FIGS. 6 and 8, the front edges of the detent elements 30, 30' are braced against the non-free leg of the latch bolt 7 and thereby hold the latter.

Figure 9:
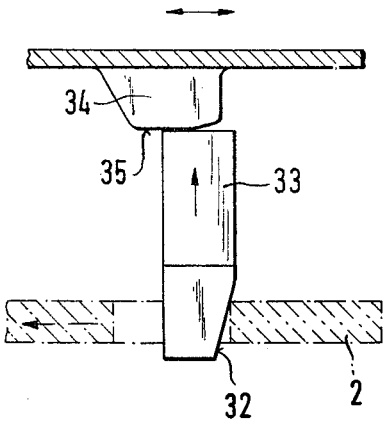
Figure 10:
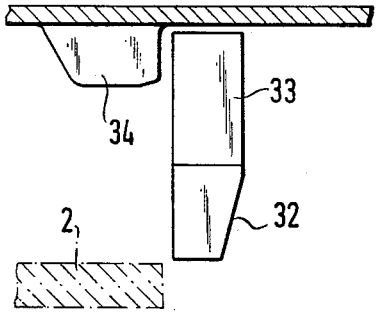

In the embodiment examples according to FIGS. 9/10, the bevel 32 of the block-like latch bolt 33 is arranged at the lower free end, and this latch bolt 33 is lifted in the direction of the arrow for shifting into the opening position. In the embodiment example according to FIGS. 9 and 10, a detent element 34 is again arranged at a separate part within the belt lock, where the latch bolt 33 is braced in the locking position against the lower boundary surface 35 of the detent element 34 and is blocked thereby. By shifting the detent element 34 in the direction of the arrow, i.e., into the position according to FIG. 10, the detent connection is released and the latch bolt 33 can move upward into the opening position by the force of a spring, not shown.

I claim:

1. Lock for a safety belt comprising a belt lock having a metallic support with two spaced plates defining an insertion path, an insertion tab attached to a belt end for insertion in the insertion path of the metallic support, a latching bolt movable transversely to the insertion path to a blocked position in which the bolt is interposed in the path of said tab and to an open position in which the bolt does not block passage of the tab in the insertion path, spring means urging the latching bolt to the blocked position, a pushbutton mounted on the metallic support movable against the force of a spring to move the latching bolt from the blocked position into the open position a detent element which is a piece of the pushbutton and movable therewith, said detent element disposed outside the insertion path and inside the transverse path of the latching bolt, preventing transverse movement of the latching bolt, and said detent element movable out of the transverse path of the latching bolt by movement of the pushbutton and, wherein the detent element is disposed in the transverse path of the latching bolt to detent the latching bolt in the open position.

2. Lock according to claim 1, wherein the detent element is disposed in the transverse path of the latching bolt to detent the latching bolt in the blocked position.

3. Lock for a safety belt comprising a belt lock having a metallic support with two spaced plates defining an insertion path, an insertion tab attached to a belt end for insertion in the insertion path of the metallic support, a latching bolt movable transversely to the insertion path to a blocked position in which the bolt is interposed in the path of said tab and to an open position in which the bolt does not block passage of the tab in the insertion path, spring means urging the latching bolt to the blocked position, a pushbutton mounted on the metallic support movable against the force of a spring to move the latching bolt from the blocked position into the open position, a detent element which is a piece of the pushbutton and movable therewith, said detent element disposed outside the insertion path and inside the transverse path of the latching bolt, preventing transverse movement of the latching bolt, and said detent element movable out of the transverse path of the latching bolt by movement of the pushbutton, wherein the detent element is on the pushbutton which can be moved against the force of said spring in the direction of the insertion path of the insertion tab and which detent element extends in the path of movement of the latch bolt in the locking position as well as in the opening position, and wherein the detent connection can be released by the insertion tab inserted into the belt lock.

4. Lock according to claim 3, wherein the detent element has at least one detent surface with a bevel for executing an additional moving excursion at the latch bolt.

5. Lock according to claim 3, wherein the pushbutton has at least one cam surface which is inclined relative to the insertion plane, and extends up to the height of the detent element, for the moving stroke of the latch bolt, and against which the latch bolt is pushed by spring force.

6. Lock according to claim 5, wherein the latch bolt is substantially C-shaped in which there are two free legs joined by a third member, the free legs have latch extensions which in the locked position engage in the insertion path of the insertion tab, and wherein the third member of the latch bolt has inclined sliding surfaces disposed against cam surfaces of the pushbutton at the height of the two free legs.

7. Lock according to claim 6, wherein the latch extensions have in the region of the insertion path a bevel which extends inclined to the insertion path.

* * * * *